United States Patent [19]

Faltin

[11] 4,135,708

[45] Jan. 23, 1979

[54] HIGH SPEED INSERT HANDLING MECHANISM AND METHOD

[76] Inventor: Hans G. Faltin, 4135 Wilshire Dr., York, Pa. 17402

[21] Appl. No.: 765,064

[22] Filed: Feb. 2, 1977

Related U.S. Application Data

[62] Division of Ser. No. 688,538, May 21, 1976.

[51] Int. Cl.[2] ..... B65H 5/30

[52] U.S. Cl. ..... 270/57

[58] Field of Search ..... 270/54–57, 270/15, 17; 93/22, 29, 62, 53 R, 53 M, 53 SD; 271/1, 2, 119, 120, 99–101; 53/381 R, 186

[56] References Cited

U.S. PATENT DOCUMENTS

| | | | |
|---|---|---|---|
| 3,269,720 | 8/1966 | Schluckebier | 270/57 |
| 3,650,524 | 3/1972 | Hepp | 270/57 |
| 3,926,423 | 12/1975 | Merker | 270/55 |

*Primary Examiner*—Edgar S. Burr
*Assistant Examiner*—A. Heinz
*Attorney, Agent, or Firm*—Laurence R. Brown

[57] ABSTRACT

The invention is a high speed feeding method and apparatus for inserting (or stuffing) products having a shorter flap portion folded over a longer body portion, which products may comprise single or multiple page signatures, cards, envelopes, or the like, for stuffing or inserting, including in-line inserting of pre-prints into newspapers after they leave the press or for directly inserting into the nip of paper webs where the sections are being brought together as multiple continuous webs, for final folding therein; or for other purposes. The flap enables positive feeding of the products for sequential high speed feeding to predetermined locations.

5 Claims, 40 Drawing Figures

31
33
35
37
39
41
43
45
47
49
51
53
53'
53''
53'''
55
57
58
59
60
63
64
65
66
67
68
69
75
76
77
78
81
81'
83
85
89
90
91
107
108

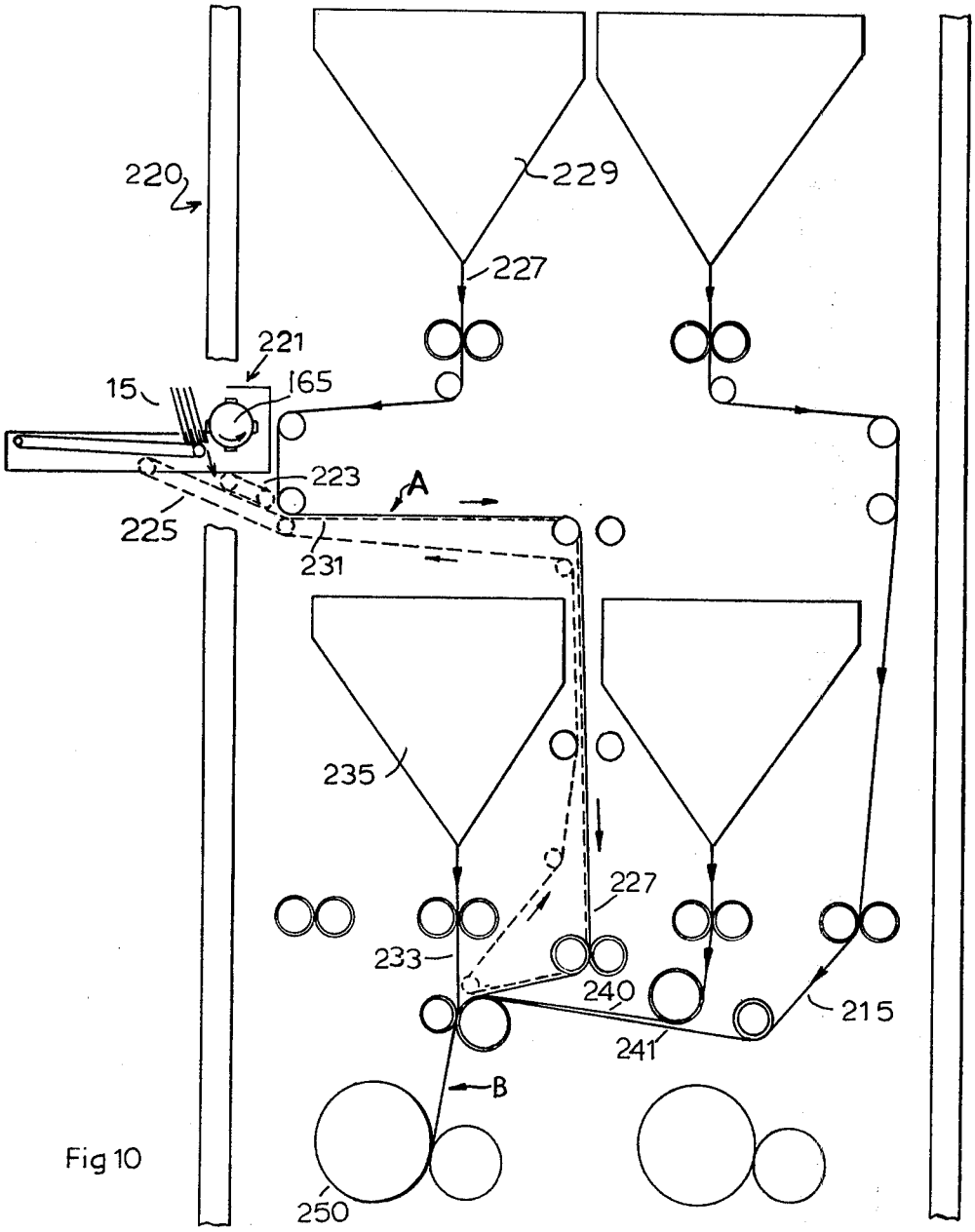
Fig 10
Fig 10A
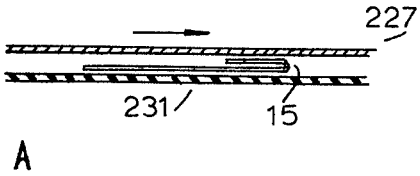
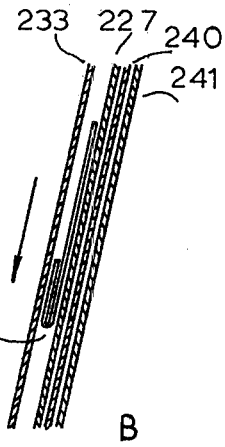
Fig 10B 400
401
410
415
416
417
420
421
422
423
423A
423B
423C
423D
425
426
427
428
430
431
432
433
434
440
445
446
460
461
462
463
464
A

HIGH SPEED INSERT HANDLING MECHANISM AND METHOD

This is a division of application Ser. No. 688,538 filed May 21, 1976.

A drum, rotated at high speed, adjacent a source of products, includes at least one cut-out for receiving a product flap, as synchronized straightening apparatus unfolds the flap and introduces the forward edge to a high speed nip for accelerating the product away from the source for sequential feeding. Novel conveyor apparatus opens newspapers, traveling at press speeds, to receive the inserts, or to receive a plurality of different inserts when more than one feeder is employed. The newspaper output production is not decreased and product insertion is effected on the mainstream flow. In other embodiments, a high speed rotary drum has one or more radially extending blades for impacting the free edge of the shorter portion of the product to push it from the source of products to speed up rollers, which have a nip for receiving the forward folded over end, for acclerating the product by pulling it between the rollers for discharge therefrom into the desired location or equipment. Booklets i.e. TV programs may be fed utilizing the same high speed bladed drum, but without a flap due to the product thickness.

Synchronizing of the drum feeding rate to a press speed permits up to 70,000 or more products to be fed into signatures of the final folded assemblage of newspaper sections; or prior to final folding, so that the product is folded with the newspaper or other carrier.

PRIOR ART

No prior art machine or method capable of the high speed of the present invention, without the use of continuous forms, is known. There are those that rely on vacuum suction pick-up for transfer, such as Cleary, Jr. 3,275,316, but they are limited to rates of about 12,000 per hour. Although Cleary, Jr. discloses a perforated flap attached to a panel, only vacuum transfer is employed, and the flap is for purposes all different from the use made by the present invention. The vacuum requires time to rebuild, and such machines are capable of feeding only about 12,000 pieces per hour. Rotary finger machines, such as Schweizer 2,634,971, as well as conventional mechanical reciprocating devices, are even slower. The closest approach to in-line feeding is described in U.S. Pat. No. 3,269,720, wherein a large rotary cylinder uses fingers to open the newspapers for receiving collated inserts, but reciprocal motion mechanisms slow the apparatus to very considerably less than press speeds. The prior art machines simply do not attain press speeds for in-line feeding at 60,000 to 70,000 pieces per hour.

THE INVENTION

The apparatus and method of the present invention relate to high speed handling of products, such as signatures, which include a folded over end or flap to comprise a short panel portion integral with the body or long panel portion. The simplest such configuration is found in a single sheet of paper having an end folded over to extend rearwardly, with the preferred length of the short panel portion being, less than one-half but greater than one-quarter, of the length of the long panel portion.

An important object of the invention is the sequential feeding of products from a source of supply to a predetermined location, at high speeds, without malfunction.

An important example of the use of the invention is the feeding of pre-printed advertising or other single or multi-page insert products, into newspapers at press speeds, without interruption.

To insure positive gripping of each product, for single feeding, the products include the flap arrangement described with the exception of products having appreciable thicknesses. Also, the product being fed must be accelerated away from the feeding station so as not to interfer with the positive handling of the successive product.

In the preferred embodiment, each product is fed away from a source of supply of products by pushing its flap to an unfolded condition, introducing the flap to a high speed nip, and thereby accelerating, by pulling, the product away from the source, to guarantee sequential feeding.

In other embodiments, the products are pushed from the source, by impact with the trailing end of the flap, to a high speed nip for acceleration, by pulling, the product away from the source, to enable sequential feeding.

In order to introduce the products into moving newspapers, or the like, alternative approaches are disclosed. Preferably, the inserting is carried out in the mail room, where, usually, greater space permits handling of the volumes of material to be stuffed. Inexpensive, relatively short but unique conveyor apparatus is inserted into the mainstream flow of shingled papers coming from the press. A section of the mail room conveyor is removed, and the new conveyor apparatus substituted. The purposes are to speed up the papers, thus unshingling them, open them to receive the inserts, close and reshingle the papers. High speed centrifugal force is used in the opening of the papers, which are stuffed, re-shingled and returned to the mail room conveyor for stacking and bundling.

The newspapers may be inserted, using the new conveyor apparatus, whether they arrive on a horizontal, vertical, high or low conveyor. Inserting is accomplished as the papers are moving from a generally horizontal reach to a generally downwardly extending reach so that momentum, in the form of centrifugal force, assisted by an initial blast of air when necessary, opens the papers, which after receiving the inserts are closed and re-shingled by a bucket drum depositing them onto the mail room or other conveyor.

A speed-up conveyor, preferably first receives the papers from the press output conveyor or mail room conveyor to increase their speed and partially un-shingle them due to overlap slippage. This avoids the "bump" problems of total un-shingling speed increase in a single step. Also, the speed-up conveyor frees the papers from hold-down wires or clamps normally employed on press and mail room conveyors.

Usually the papers include a lip, and, if necessary, press adjustment is made to insure that the lip is always on the bottom or lower side of the paper, i.e. adjacent the conveyor. A chain conveyor, equipped with pushers, usually spaced apart approximately 14 inches, receives the papers from the speed-up conveyor. The speed of the chain conveyor is sufficiently high that the pushers engage the lips of the papers to complete the un-shingling. A central finger clamp engages the lips to clamp the papers to the chain conveyor such that when guided, at high speed, to a downward reach, the unclamped (non-lipped) portion will go forward or "fall" to open the paper.

Preferably, the opening conveyor extends around a vacuum distribution drum of approximately one foot in diameter. While the vacuum system is continuous, the drum uses suction for only about 90 degrees, to hold the lip portion of the paper against the conveyor as the folded forward edge is directed downwardly. This allows the unclamped portion of the paper to flop outwardly, thereby opening the paper for inserting. A spaced roller or conveyor serves as a stop for the flopped portion of the paper and assists in buiding the now stuffed paper downwardly into a bucket of a bucket drum, which may be identical to the bucket drum, which shingles papers from the press. Thus, the stuffed papers are returned to the mail room conveyor in the same shingled condition as they were when leaving the press.

When tabloids are being stuffed that have no lip, a forwardly extending knife edged clamp may extend between pages of the tabloid to determine a random opening for receiving inserts. The height of the knife above the pushing conveyor may be randomly set to clamp a few or many pages of the tabloid. Camming tracks may be used to operate and release the clamps.

The same principles obtain for use with different elevations of press output conveyors. For low horizontal conveyors, the un-shingling and paper opening conveyors may comprise an uprising conveyor to deliver clamped papers to a vertical downward approach for opening and stuffing.

Several feeding stations of identical or mixed variety, including when desired, Ad-A-Card feeders, may feed an input conveyor with a plurality of inserts and the input conveyor, in turn, inserts the plurality into the opened newspapers, in lieu of the single feeding above described.

The products may also be introduced into the newspapers by feeding them singly into the nips of moving webs, prior to final folding, so that they are folded over one or more inner signatures for positive retention, but they are readily available, and even become dislodged when the signatures are separated by the reader.

In the various embodiments of the invention disclosed, all may feed a great number of types of products. These comprise single sheets with double folded forward ends, four or more page products with single folds, or double sheets or more with additional folds, or multiple sheets with double folds or double additional folds. This includes products having longitudinal folds, parallel folds and cross folds. Such products may comprise advertising sheets, fliers, pamphlets, tabloids, bingo cards and the like, but they all have in common a long panel portion and a folded over short panel portion.

The feeding apparatus may be used for in-line inserting into continuous moving webs, such as a Sunday supplement into the Sunday newspaper, and/or for depositing signatures between continuously moving webs at predetermined locations, preferably prior to the final folding operation in order that the signature will be caught in the fold and folded with the newspaper, to retain it in position until the purchaser opens the paper.

The feeding operation is capable of being carried out at full press speeds and has been demonstrated at speeds over 100,000 pieces per hour. The advantages are many in employing this invention over the prior art. For example, in feeding to a press or other press associated utilizing device, all timing problems are eliminated by simply synchronizing the feeding apparatus to the device, as by driving it from the press drive. Individual pre-printed advertisements or the like may be employed at will, and without resort to continuous perforated strips of fan-folded products. For example, a manufacturer of tire chains may have thousands of advertising pieces pre-printed and stored at the newspaper for instant insertion when it snows or snow is forecast. A tremendous advantage here is the fact that printer's errors have already been removed.

Seasonal timing advertisements and repeats of both are available. Also, no splicing is necessary, and even the folds can be off slightly and still accommodate the high speeds.

This method permits the elimination of the use of glue entirely and avoids hot melt contact with personnel. No perforated feed holes are required. No vacuum build-up or suction cup or finger transfer is employed nor slow reciprocating mechanisms. Fast acceleration with guaranteed separation is enabled as a vacuum simply cannot build up fast enough to cycle at such speeds. Double feeding is eliminated. Expensive electronics may be eliminated. A variety of sizes and shapes may be incorporated. Press runs of the straight or collect modes may be accommodated. The feeders may be used per se, or as newspaper or other (eg. envelope) inserters and they are extremely inexpensive as compared to the prior art. The single feed high speed feeding may be accomplished without bursting. Any flat advertisement or insert can be folded over for lip feeding and, when the newspaper is unfolded, it will drop out or at least stand out for attention.

The feeder may be attached to a press simply using belts for inserting, being driven from the press motor, or it may discharge directly into moving webs.

In one of the embodiments, the rotary drum with blades is positioned below the supply of products and is accordingly referred to as a bottom feeder. The source may comprise simply a stack of products with the short panels downwardly and the free edge or trailing edge of the small portion facing rearwardly so that the bottom product is pulled out by impact of the blade of the drum with the trailing edge of the flap. In start-up, it is preferable to employ an adjustable gate which is adjusted downwardly, to the path of the products leaving the mouth of the supply, so that only a single product is pushed out at the slower speeds. However once the speed is increased from the initial start-up, the gate is unnecessary, because the high speed pushing of the bottom product is similar to the fast pull of a tablecloth from under dishes on a table.

The bottom feeder may also be supplied with products from a moving conveyor delivering them into the supply bin, wherein preferably a pair of limit switches maintain minimum and maximum capacity by controlling the operation of the input conveyor. The products are supported above the drum and the blades push them out as before.

The rotary drum may assume different configurations, and this is particularly helpful when flimsy or thin products are being fed. Preferably, it is straight cylindrical with three peripheral grooves in which three bars of a bridge, hinged to the bin supply side or back support plate of the drum, provide a stable pathway. In order to start or stop the feeder mechanism quickly, it is only necessary to raise or lower the hinged bridge so that the blades do not strike the products. A second rotary drum may be convex with the back support plate and any front support plate also being similarly curved to compensate for the weight of paper bowing the stack. Also, to avoid buckling, a concave roller may be employed with the bridge to offset this problem. Similar curvature may be incorporated into support or guide plates adjacent the drum.

Another type embodiment is termed a top feeder because the rotating drum is located above the source of supply so that the blades strick the now upwardly (at an angle to the horizontal) positioned products by impacting the free or trailing end of the short panel and pushing it toward the nip. A pressure sensor controls a belt feed which replenishes the supply between limits.

In a further embodiment, a gravity fed side-type pusher feeder may be employed wherein belts or chain drives are not needed for supplying new products to the source but, of course, could be employed. A platform, on an angle of approximately 30 ° to 45° above the horizontal, receives the stack of products with the short end down and the free or trailing end thereof upwardly for impact by blades of a drum, singly to push the products between accelerating rollers located below the angled platform.

The unfolding type feeder operates best in the mode depicted, but is capable of operation in any of the modes disclosed herein.

Any of these feeders can be used to insert the product between moving webs at press speed or directly into open papers, and exemplary systems of these types are herein shown and described.

The invention will be better understood from a reading of the following detailed description thereof, when taken in light of the accompanying drawings wherein FIG. 1 is a view in perspective of a single fold, two page product;

FIG. 10 shows a top feeder supplying the product between continuously moving webs;

FIG. 10A and 10B show details of FIG. 10;

Figure 26:
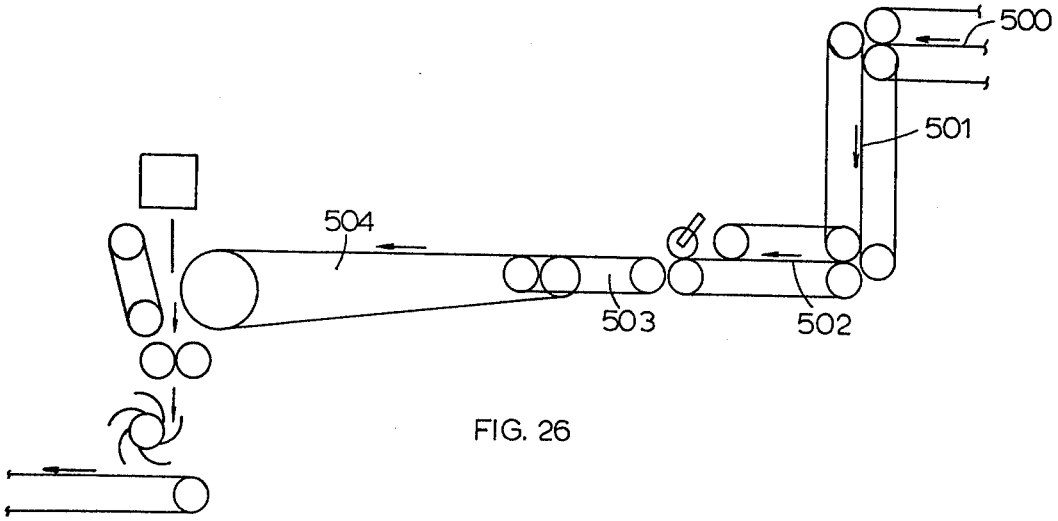
Figure 27:
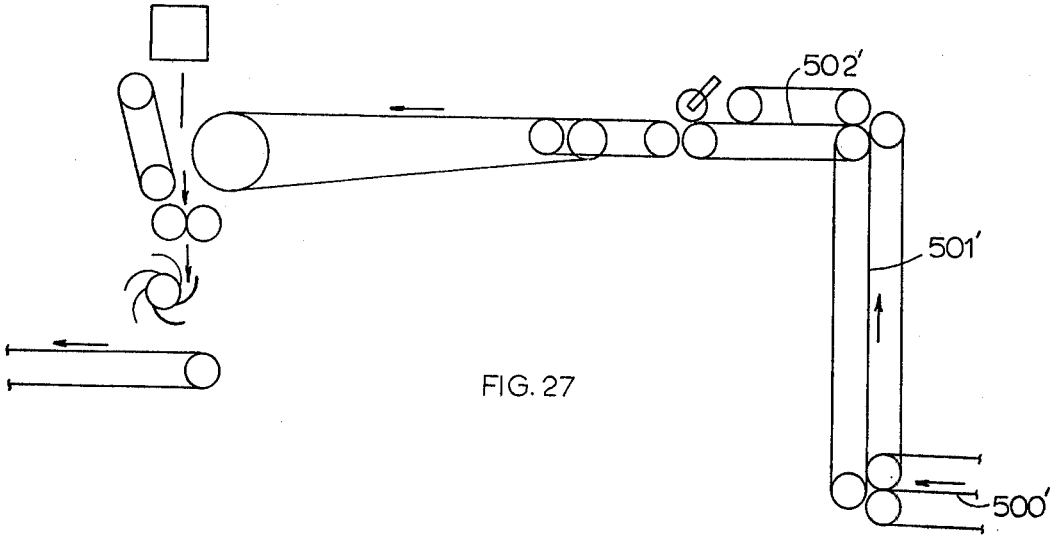

FIG. 26 and 27 simply represent conveyor arrangements for facilitating feeding of inserts.

Figure 1:
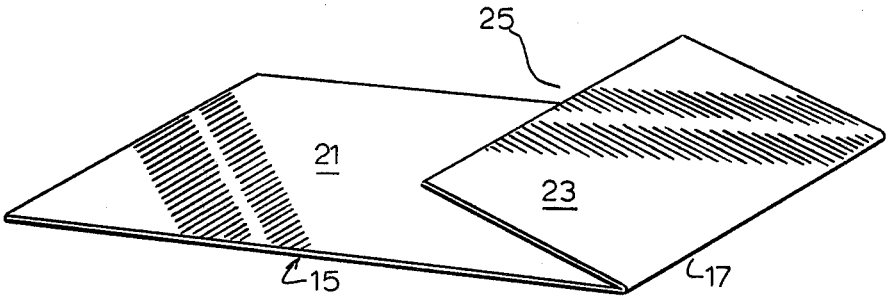

Turning now to FIGS. 1 through 4, typical products for use with the subject method and apparatus are shown, but many other types of products having the lip type fold on one end may also be accommodated. In FIG. 1, a single sheet product 15 is shown folded over at 17 to leave a long panel 21 and a flap or short panel 23. The single sheet product 15 may comprise a single ply or two pages depending on whether it is printed on one or both sides. The length of the short panel 23, folded over the long panel 21, is approximately one-quarter to one-half the length of long panel 21. It has been found that shorter lips tend to catch within each other and interfere with high speed feeding. Also, shorter lengths may not be sufficient for the nip to receive and pull on. Furthermore, stacking, without tilting, is facilitated with this type fold.

It is the free or trailing end 25 of the short panel 23 which is impacted to remove the product 15 from the bottom of a stack, the forward end of a stack or the angled end of a stack, depending upon the placement of the rotary drum with blades. Usually, the single sheet product 15 would be of a stiffer stock in order to feed properly. It is the folded over or forward end 17 which is received in the nip of the accelerating rollers.

Figure 2:
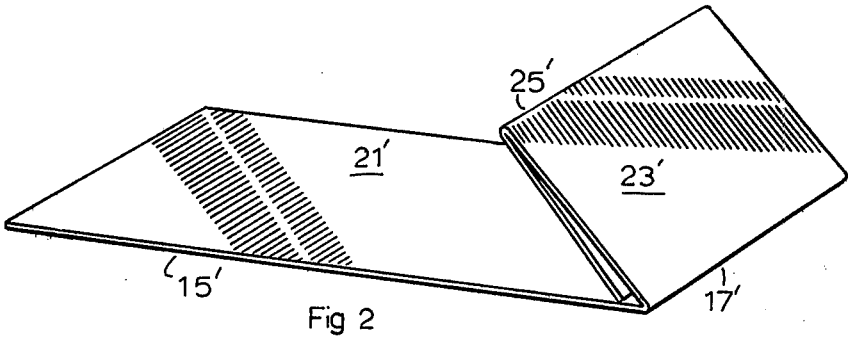
FIG. 2 is a view in perspective of a double fold, two page product.

In FIG. 2, the product 15″ may be termed a single sheet, one or two page product, having a double fold, the long panel being 21″, the short panel 23″, the folded over or forward end 17″, and the free or trailing end 25″.

Figure 3:
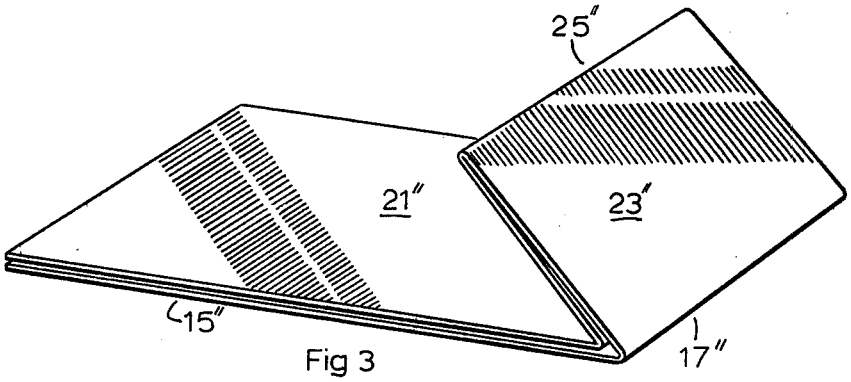
FIG. 3 is a view in perspective of a double fold, four or more page product.

In FIG. 3, the first fold, four or more page product 15″ is shown with long panel 21″, short panel 23″, the second fold over or forward end 17″, and the free or trailing end 25″, it being realized that like configurations to FIG. 3 may be tucked internally thereof to comprise a great many sheets or pages with but a single trailing end 25″ and forward end 17″.

Figure 4:
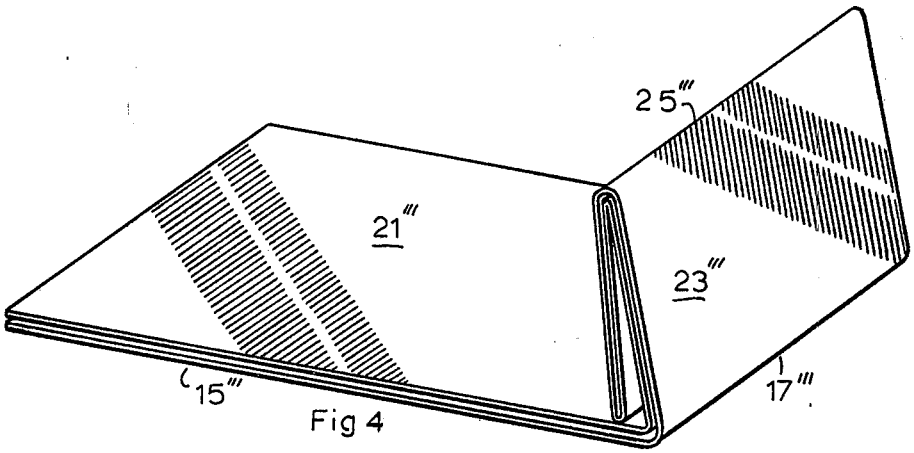
FIG. 4 is a view in perspective of a triple fold four or more page product.

The same is true of the four or more page, triple folded product 15‴ of FIG. 4 wherein the long panel is 21‴, the short panel 23‴, the forward end 17‴, and the trailing end 25‴.

Several reasons exist for the various types of products, i.e., to compensate for flimsiness or for extra length or to use up paper to gain entrance to the machine or to provide the various types of cards, envelopes, tabloids, pamphlets or the like, which are necessary or desired. But in any event, the principle of high speed feeding is the same for all products.

BOTTOM FEEDER

Figures 5, 6A:
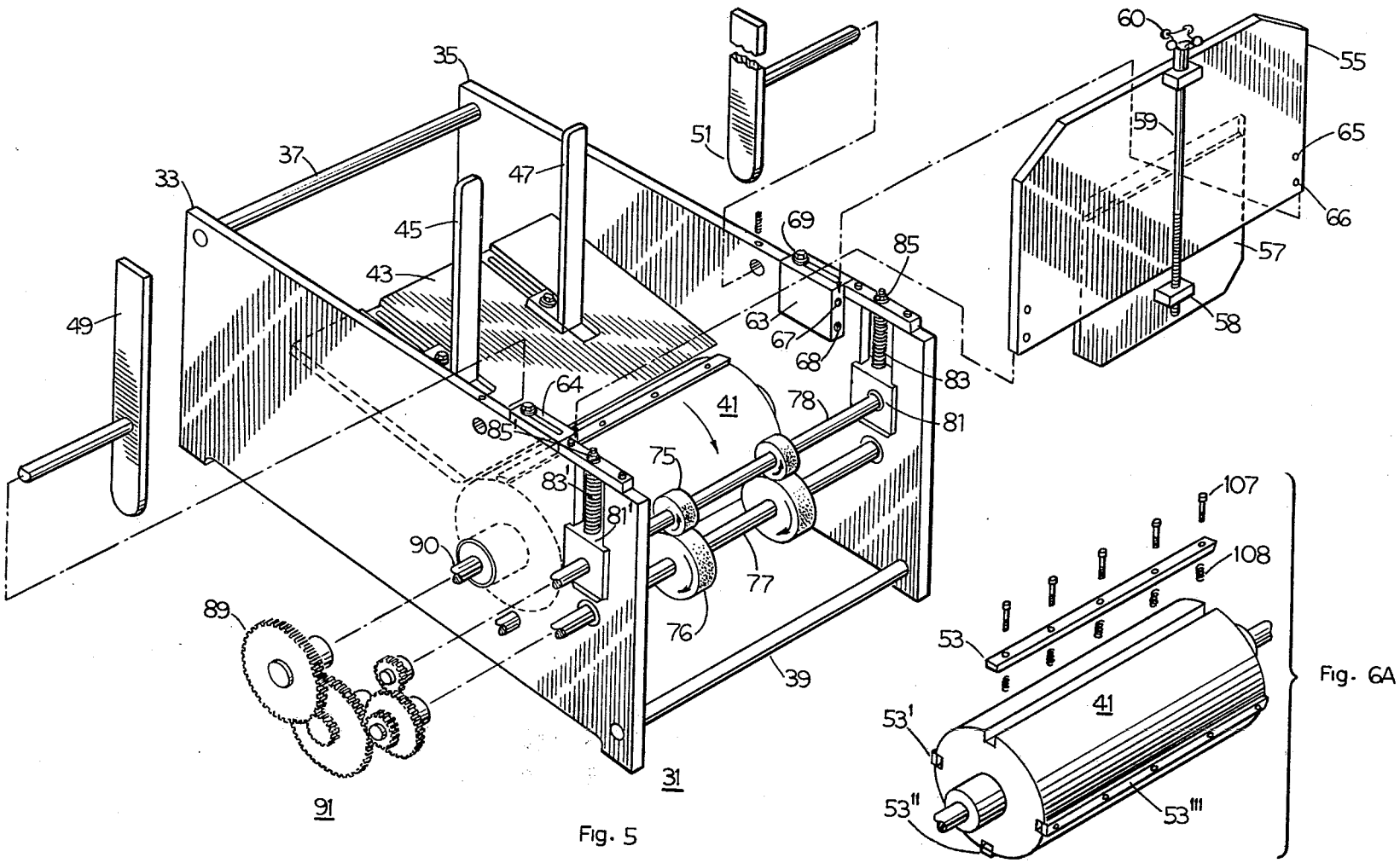
FIG. 5 is a view in perspective of a bottom pusher type feeder.
FIG. 6A is a view in perspective of a rotary feed drum for use in the structures of FIGS. 5 and 6.
Figure 6:
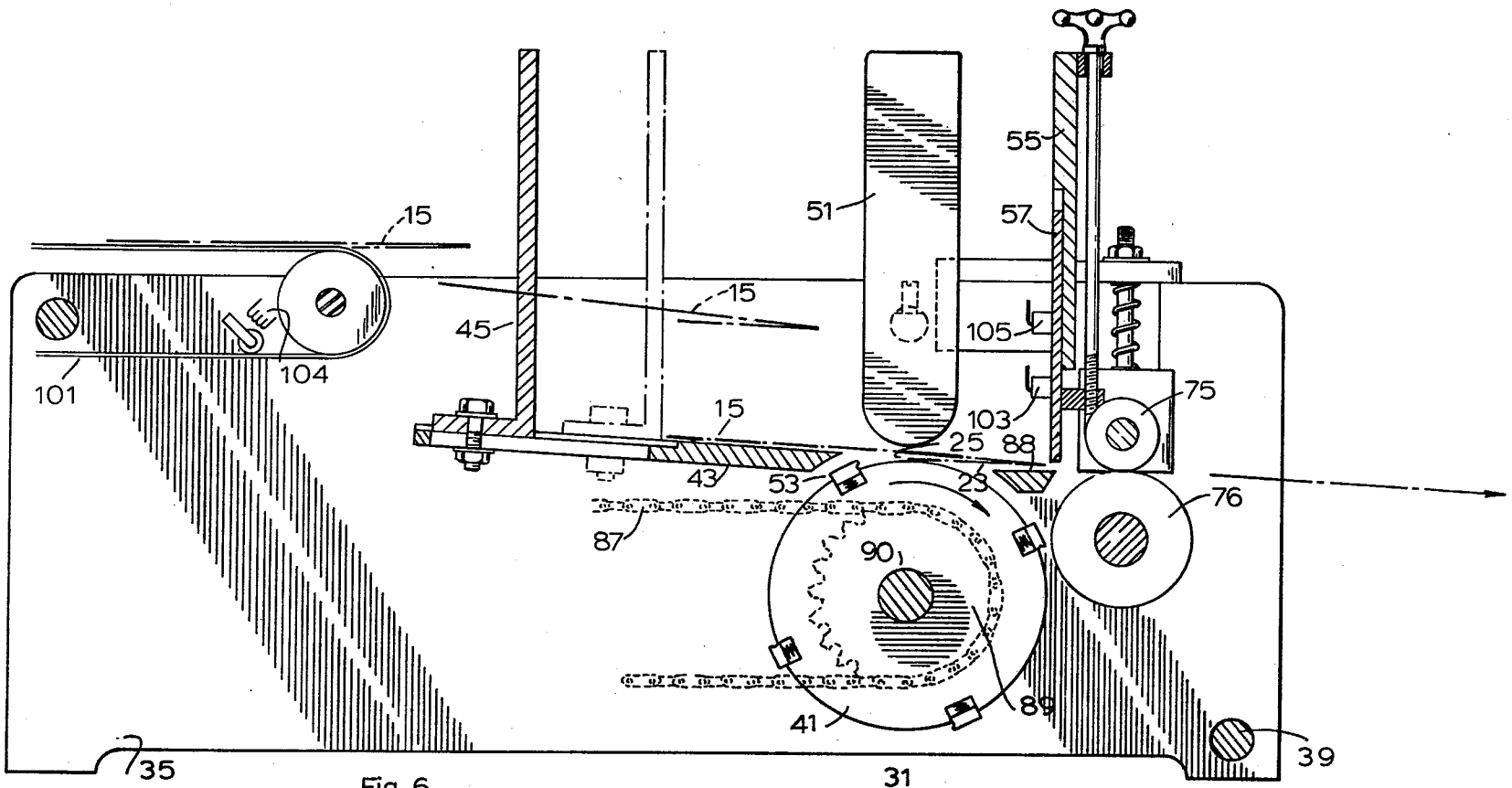
FIG. 6 is a view in side elevation of the bottom pusher type feeder.

In FIGS. 5 and 6, the bottom feeder is generally shown at 31, as comprising a pair of spaced apart side plates 33 and 35 suitably fixed together by rods, such as 37 and 39, and carrying therebetween the rotary feed drum 41. As inclined rear base plate 43 is suitably fixed between the side plates 33 and 35 to carry the stack of products (not shown). This stack or supply of products may be neatly adjusted on rear base plate 43 by moving the adjustable back straps 45 and 47, forwardly or rearwardly, and adjustable side guides 49 and 51 inwardly or outwardly. The forward edge of the stack rests against gate 57 of front stop 55 which adjustably carries the gate 57 through the means of a lug 58, screw shaft 59 and knob 60. The front stop 55 is supported by the side plate blocks 63 and 64, using screws (not shown), which penetrate front stop at apertures 65 and 66, and are received in threaded holes 67 and 68, as in block 63. The blocks 63 and 64 are adjustable longitudinally of the side plates, such as 35 by hexogonal screw 69.

In FIG. 6, the position of gate 55 is seen forward of the center od drum 41. This is because the product 15 has the short panel 23 downwardly and rearwardly extending for impact of its trailing edge 25 by blade 53 to push the lower-most product into the nip of accelerating rollers 75 and 76.

Adjustment of the gate upwardly and downwardly compensates for the thickness of a product 15, and the adjustable back straps 45 and 47 accommodate the various lengths of the products.

The accelerating rollers 75 and 76 are carried by the side plates 33 and 35 on the shafts 77 and 78, with upper shaft 78 being vertically adjustable to control the pressure exerted by roller 75 on roller 76. Upper shaft 78 is journalled in the boxes 81, 81', which are pressure loaded by springs 83, 83' to spring apart. Adjusting nuts 85, 85' are used to set the optimum pressure between the accelerating rollers depending upon whether heavy or light products are being handled.

In FIG. 6, a chain drive 87 is shown as the main drive to sprocket 89 which is affixed to rotary feed drum shaft 90. This main drive also drives accelerating shafts 77 and 78 through the gear assembly drive mechanism 91 (FIG. 5). The chain 87 may be driven from any source or may be driven from a press or other mechanism to which the device is feeding products.

The feeders of FIGS. 5 and 6 may be loaded with a stack of products from the top or by continuous feeding, utilizing the conveyor 101, delivering products against the gate 57. When the continuous supply approach is utilized with conveyor 101, a pair of microswitches 103 and 105 are connected to gate 57 to serve as limit switches for the products resting against gate 57. Switches 103 and 105 control an electric clutch 104 which simply starts and stops supply conveyor 101, switch 105 turning off the conveyor at maximum level and switch 103 turning on the conveyor at minimum level.

In FIG. 6A, the drum 41 is shown per se, having a plurality of blades 53, 53', 53" and 53"' radially protruding from the periphery thereof. The extent of the protrusion of the blade is adjustable through the use of screws 107 and springs 108, so that various thicknesses or products may be compensated. Another reason to make the blades removably adjustable is to control the speed of blade impact by removing or adding one or more blades or adjusting selected blades to inoperative positions.

A specific working example which has successfully fed 60,000 pieces an hour may be described in connection with the showing of FIG. 6. The length of the long portion of product 15 by way of example was 8⅜". The length of the short portion 23 was 3½". The diameter of the drum was 6". The distance from the nip of rollers 75 and 76 to the gate 57 was ⅝". The speed of the drum 41 was 250 r.p.m. for a surface speed of 392 ft. per min. The surface speed of 1½" diameter roller 75 and of 3" diameter roller 76 was 1,574 ft. per min. The particular type product being fed was product 15 of FIG. 1. Thus, the drum moved the product approximately ⅝", and the nip rollers then took over. There is reason to believe feeding can be successfully maintained at over 100,000 pieces per hour.

Figure 6B:
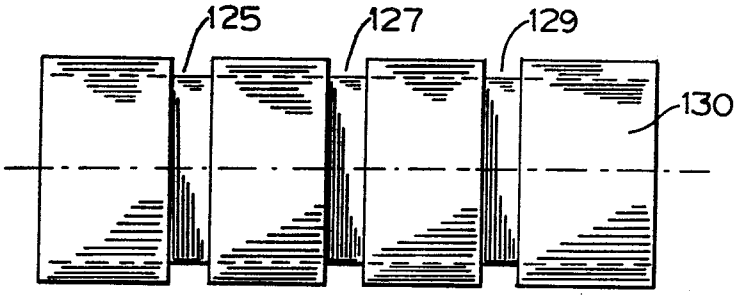
FIG. 6B shows a straight rotary feed drum with bridge grooves.
Figure 6C:
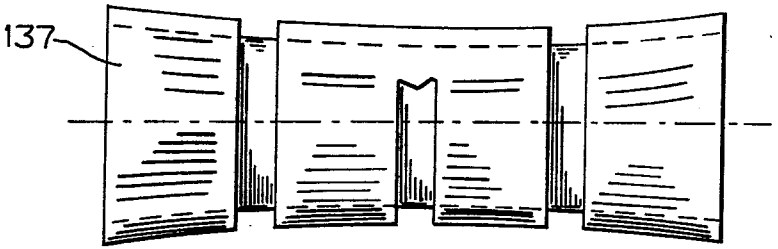
FIG. 6C shows a concave rotary feed drum with bridge grooves.
Figure 6D:
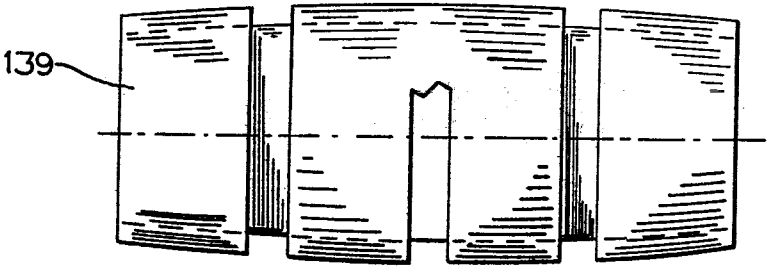
FIG. 6D shows a convex rotary feed drum with bridge grooves.
Figure 6E:
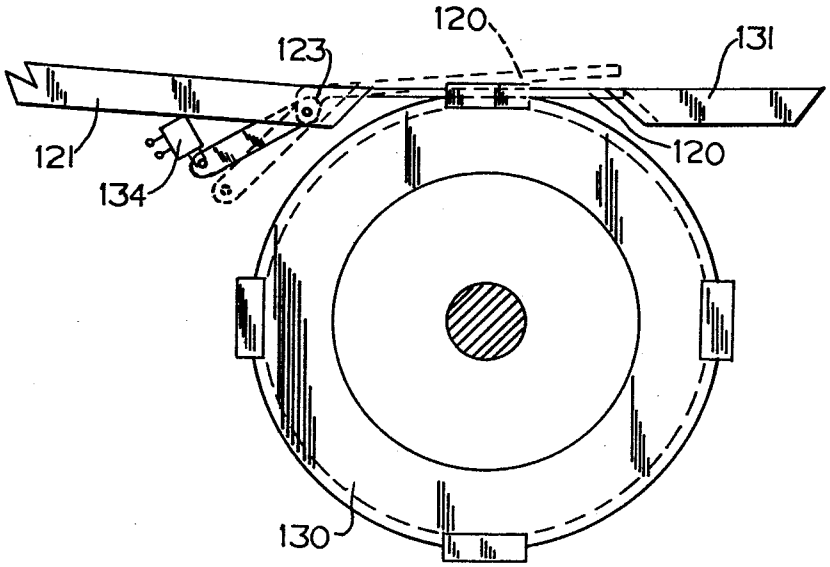
FIG. 6E is a view in side elevation of a rotary feed drum with hinged bridge, used on pusher type feeder.

FIGS. 6B through 6E relate to modifications relative to the drum, with FIG. 6E showing the addition of a bridge 120, hinged to a back plate 121 at 123, and riding in grooves 125, 127 and 129 of drum 130 of FIG. 6B. It may be appreciated that the bridge comprises three bars adapted to span the space between back plate 121 and forward plate 131 (FIG. 6E). This structure is provided for accommodating flimsy paper to prevent it from sagging and maintain the high speed action.

It is also provided to permit quick start and stop of the feeding action through the provision of electromagnet 134 which raises and lowers bridge 120.

In lieu of drum 130, either the concave drum 137 of FIG. 6C or the convex drum 139 of FIG. 6D may be substituted. However, in case of substitution, it is desirable, although not necessary, that the back plate 121 and forward plate 131 be curved in conformity with the curvature of the drums to enhance the offsetting action, i.e., avoid buckling.

It might be mentioned that for stiffer products the curved structures may be used with or without the bridges and slots.

TOP FEEDER

Figures 7, 7A:
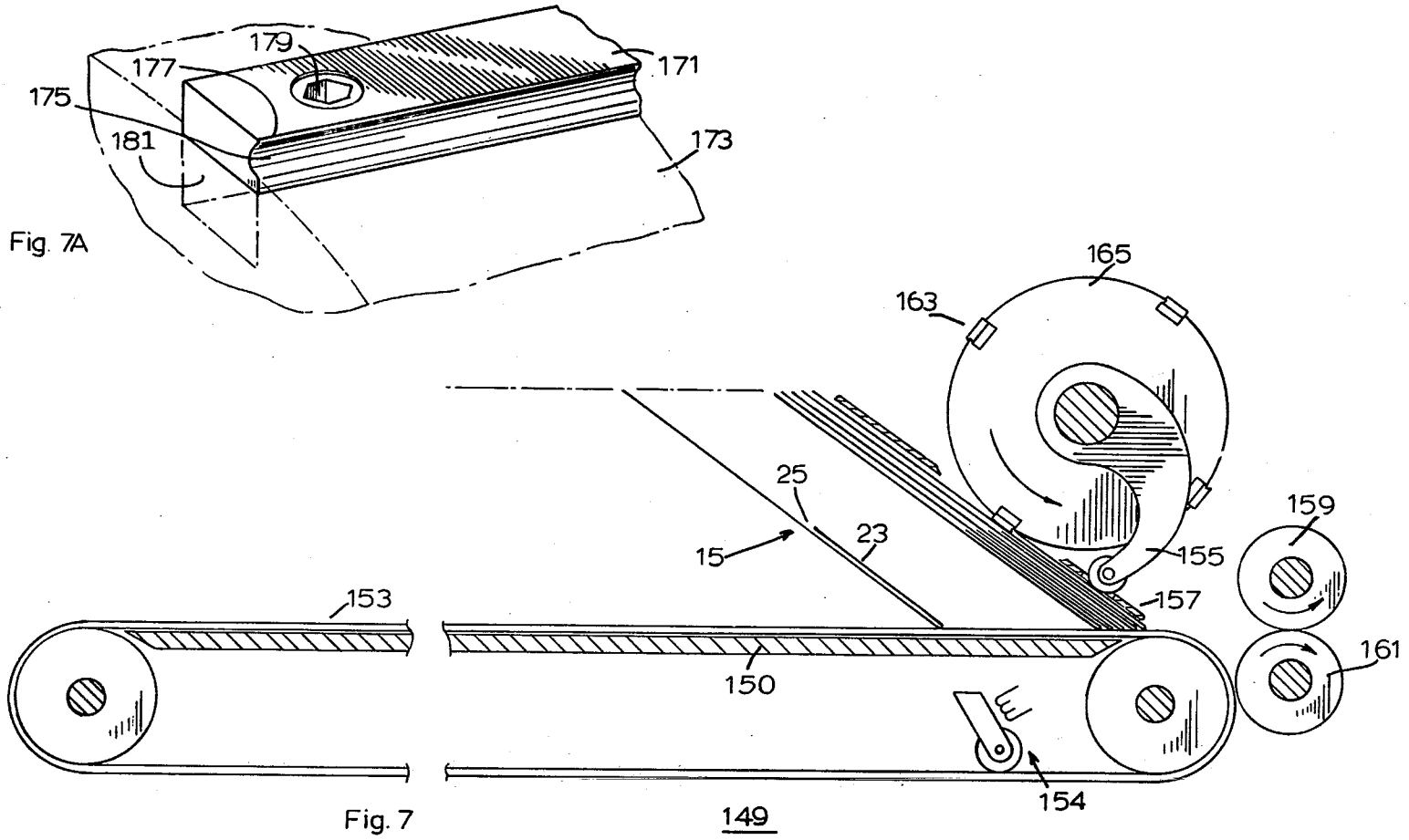
FIG. 7 shows a top pusher type feeder in side elevation.
FIG. 7A is a perspective detailed view of one suitable blade for the rotary feed drum.
Figure 12:
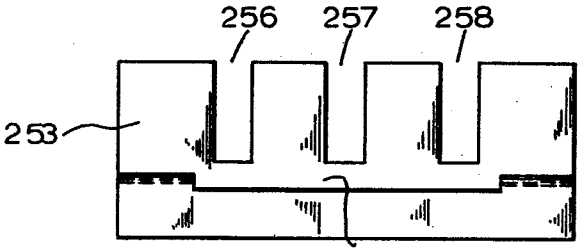
FIG. 12 is a view, in front elevation, of a gate for the feeder of FIG. 11.

In FIG. 7, there is illustrated a top feeder 149 which employs a table support 150 conveyor 153 for transporting products 15, with the small or flap portion 23 forward, and at an angle of approximately 36° to the table 150. These products are conveyed to their source position against sensor arm 155 and are automatically replenished under control of this pressure sensor arm which releases a clutch drive 154 for conveyor 153 when a predetermined pressure is sensed to stop feeding new products to the source; then, it restarts the conveyor to maintain an adequate source of supply for the feeding. A guide 157 is provided as being equivalent to the forward bar plate 88 of FIG. 6, to make certain that the products are guided into the nip between rollers 159 and 161.

This top feeder is also of the pusher type, since the blades 163 of drum 165 engage the trailing edge 25 and push the product 15 for engagement by the nip between speed up rollers 159 and 161. This particular structure offers two advantages as follows:

1. It always removes the top product so there is no real weight on it; and,

2. The gate guide 157 prevents flap buckling.

Of course, the angle of the products to the platform 150 may vary considerably, but the 36° is given as an operative number. Also, of course, the gate guide 157 may be of the three bar type and drum 165 of the straight type, as shown at 130 in FIG. 6B.

In FIG. 7A, a detailed view of one suitable type blade 171, in relation to drum 173, is shown. This drum includes a slanting or upwardly curved surface 175 with a prominent portion or lip 177 to insure that the blade always receives the trailing edge 25. An Allen screw type adjustment 179 permits both the height of blade 177 in slot 181 to be adjusted, and also the blade to be removed.

SIDE FEEDER

Figure 8:
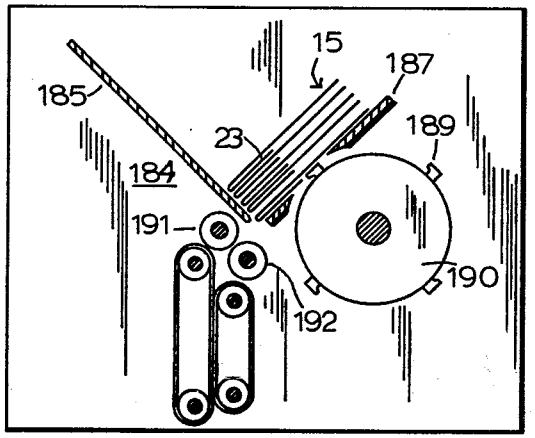
FIG. 8 shows a gravity fed angle or side type pusher feeder.
Figure 11:
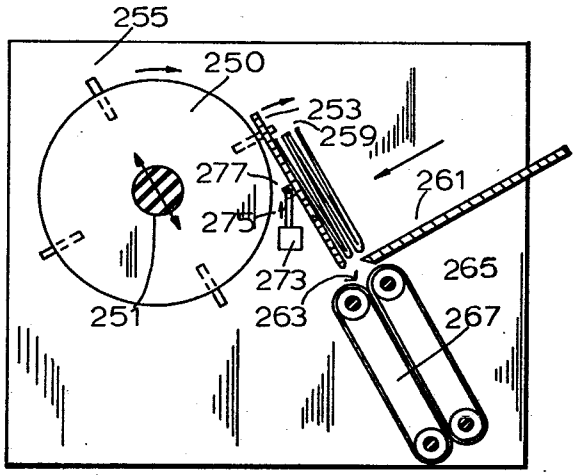
FIG. 11 is a schematic view of a booklet type feeder.

In FIG. 8, a gravity fed, pusher type feeder 184 is disclosed, wherein supply belts or chains are unnecessary. A platform 185 is provided at an angle of approximately 30° to 45° with the horizontal, preferably closer to 45°. The products 15 are simply loaded onto platform 185 to comprise a source stacked against gate guard 187 with the small flap portion 23 forward for engagement by the blades 189 of drum 190 for downward delivery to the accelerating rollers 191 and 192.

The drum 190 may be of any of the types previously described, with or without the bridge and cooperating curved structure.

The advantage of this structure is that the weight vector is less as there is limited weight against each piece and the pieces need not be backed up. It also admits of continuous feeding and it takes advantage of gravity feeding, and the work exit is almost vertical as contrasted to horizontal exits.

Figure 9:
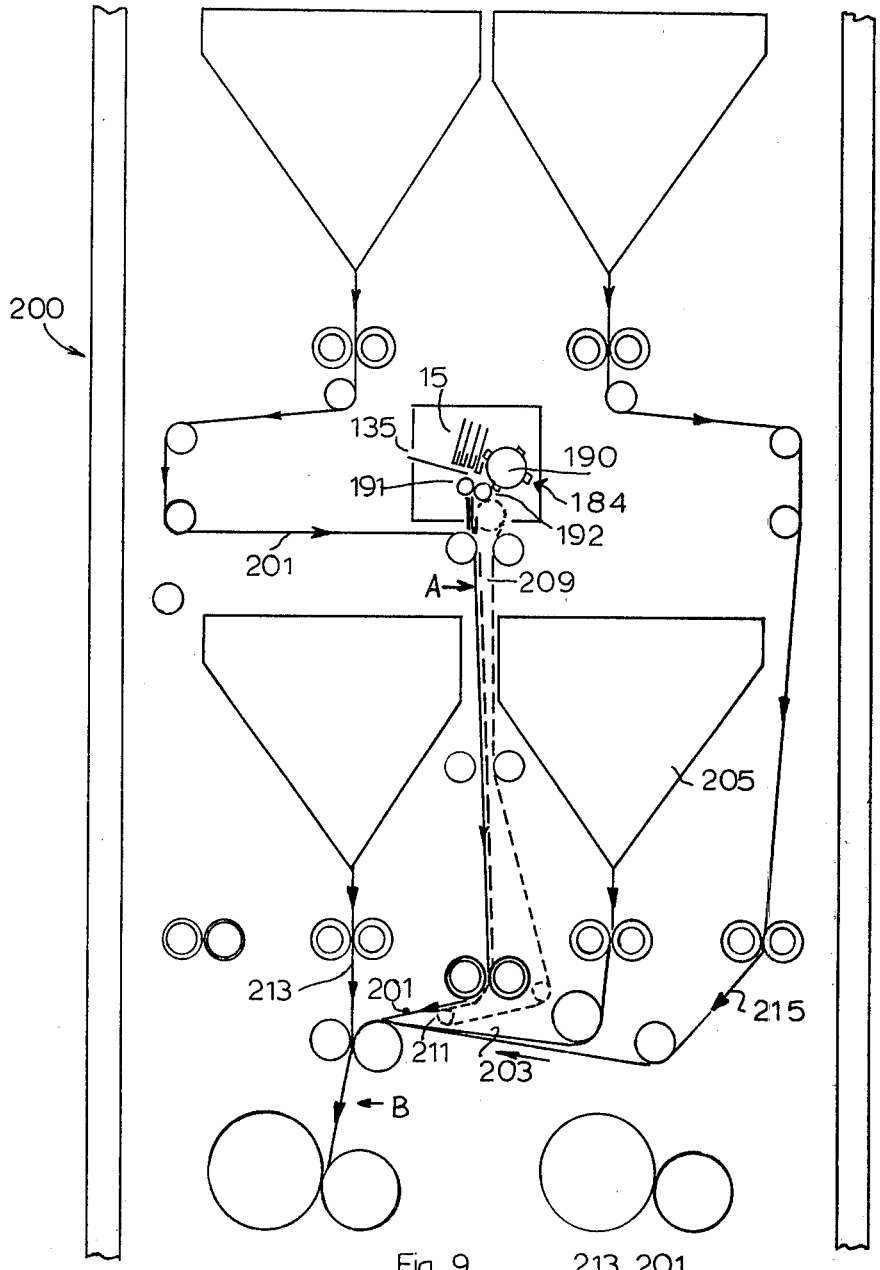
FIG. 9 shows the side feeder supplying the product between webs of a plurality of continuously moving webs.

FIGS. 9 and 10 show methods of introducing the products, at high speeds, into continuously moving webs at predetermined positions. In FIG. 9 it may be assumed that the frame 200 is that of a printing press or the like, and that a continuous web 201 is desired to serve as one carrier for the product 15 (FIG. 9A) with the object being to locate the product between double web 201 and double web 203, the latter of which has been delivered from the press former 205, preferably prior to the final folding in order that the product may be incorporated between these two webs (and other outer webs) in the final fold. The side feeder 184 is shown being employed in this operation, although the principle of the top or bottom feeder would also serve to load presses in similar manner. The products 15 are stacked on platform 185 at an angle to the horizontal. Drum 190 pushes the products individually into accelerating rollers 191 and 192 where they are gripped between double web 201 and belt 209. Since belt 209 is end-less at roller 211, the product 15 is now included between double webs 201 and 203 for delivery to the final folder or other utilization.

Figure 9A:
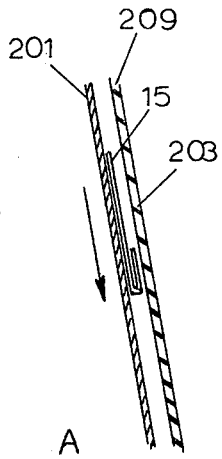
FIG. 9A and 9B are detailed showings of FIG. 9.
Figure 9B:
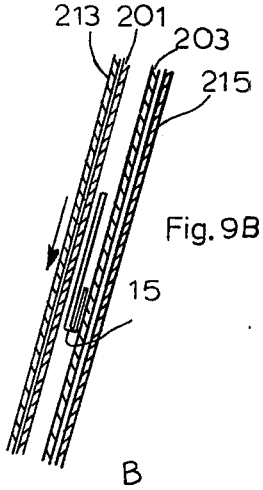

FIG. 9A illustrates product 15 between double web 201 and belt 209 at point A, and FIG. 9B illustrates product 15 between double web 203 and double web 201 with double web 213 being exterior of double web 201 and double web 215 being exterior of double web 203. Of course, the side feeder 207 may be employed to feed into any number of configurations of web to web, belt to web, and belt to belt or to discharge the products into storage or other utilizers.

In FIG. 10, the continuous web handler may be seen supported by the frame 220 with a top feeder 221 feeding products 15 between a pair of belt conveyors 223 and 225 as a result of rotation of drum 165. Upper double paper web 227 from press former 229 and lower conveyor 231 receive the product from conveyors 223 and 225, ultimately to locate it between double paper web 227 and double paper web 233 from press former 235.

In FIG. 10A, the product 15 is seen at point A between the belt of conveyor 231 and double paper web 227, whereas in FIG. 10B, the product 15 is seen at point B between double paper web 233 and double paper web 227 with double paper webs 240 and 241 being external of double paper web 227. The press folder may be illustrated at 250 and the products carried therethrough for final folding within the assembled paper prior to cutting.

FLAP UNFOLDING FEEDER

FIGS. 13–20 schematically depict the operation of the flap unfolding type feeder. Drum 300 includes the flap receiving cutouts or troughs 302 and 303.

Figure 13:
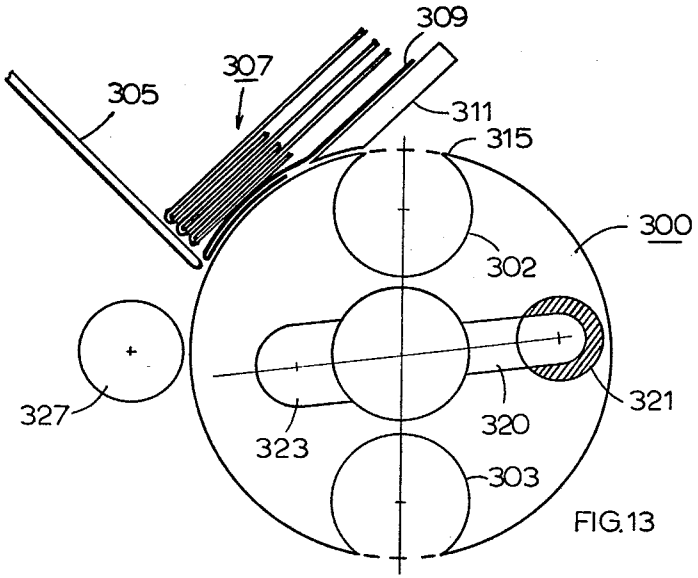
FIGS. 13–20 depict the structure in stages of operation of the unfolding type feeder.

In FIG. 13, gate 305 holds back the stack 307 of products except for lowermost product 309 having flap 310, shown in position to be unfolded. The stack 307 is supported on platform 311 and the periphery of drum 300 but high volume, low pressure air emitted by the drum periphery, decreases the resistance between the lowermost product 309 and drum 300. Also, air is directed forward of cutout 302 by a passageway 313 (FIG. 21) in trailing edge 315 (FIG. 13) initially to assist in unfolding flap 310 from product 309.

Figure 14:
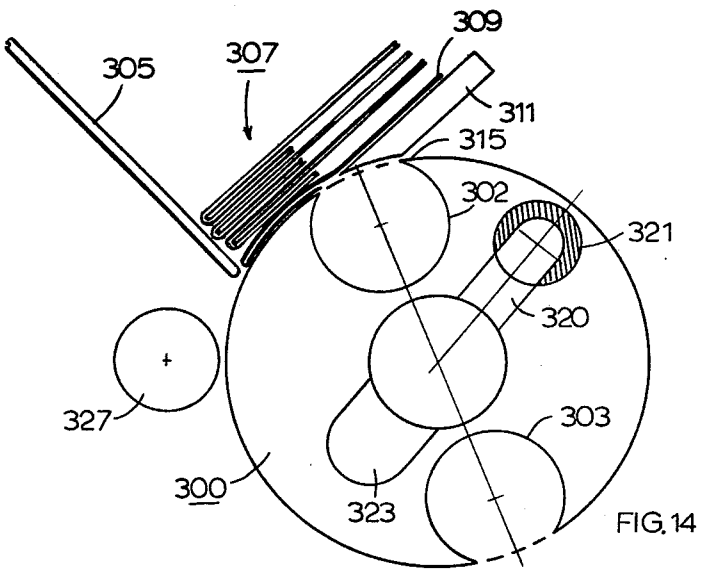
Figure 15:
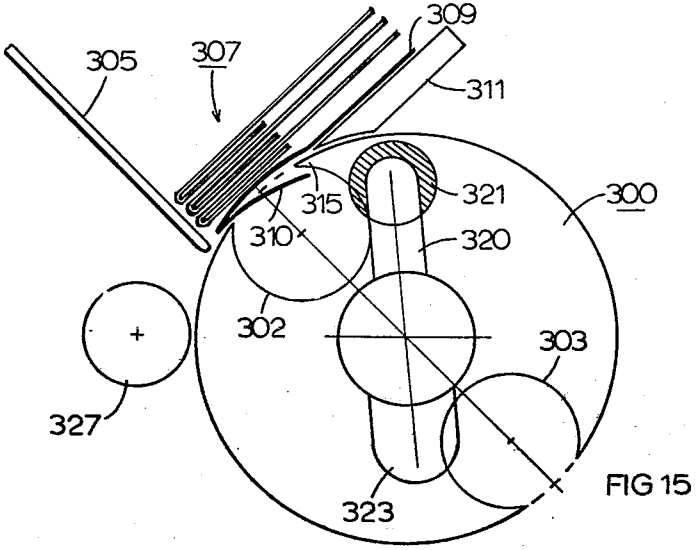
Figure 16:
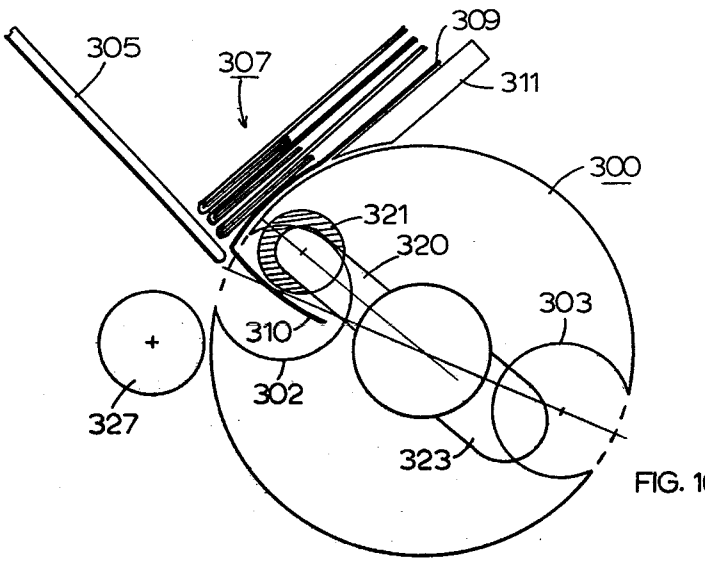
Figure 17:
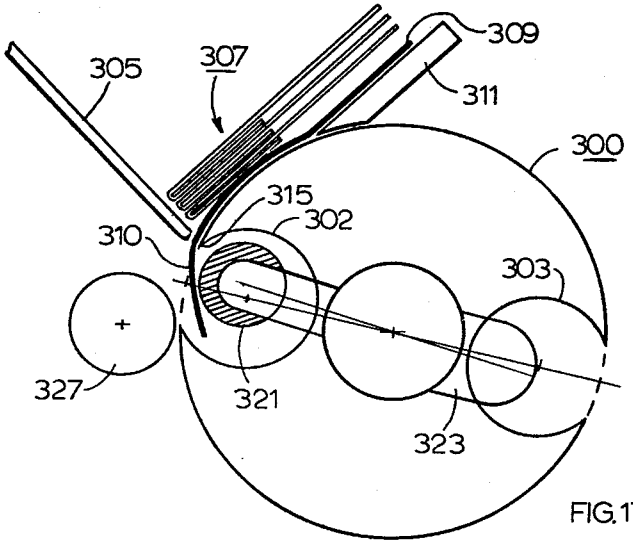
Figure 19:
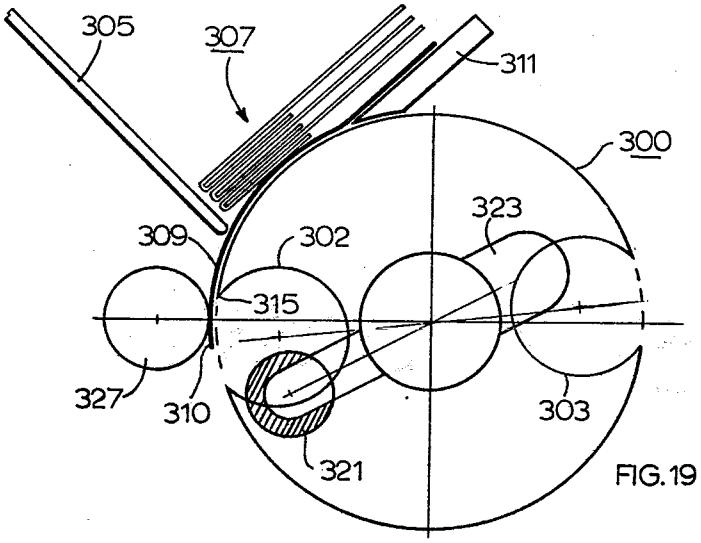

FIGS. 14 and 15 show drum 300 advancing to start the unfolding process. Straightening arm 320 is traveling at twice the speed of drum 300 and carries a roller or wheel 321 to complete the unfolding of flap 310, as depicted in FIGS. 16 and 17. Arm 320 and wheel 321 are counterbalanced by oppositely extending arm 323.

Figure 18:
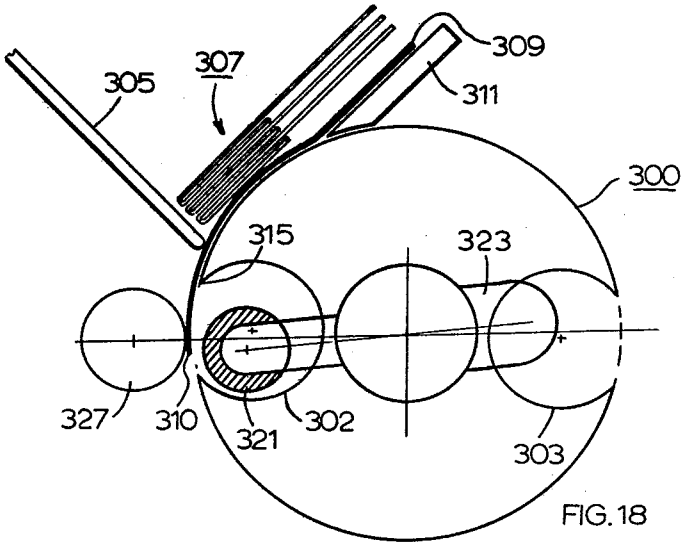
Figure 20:
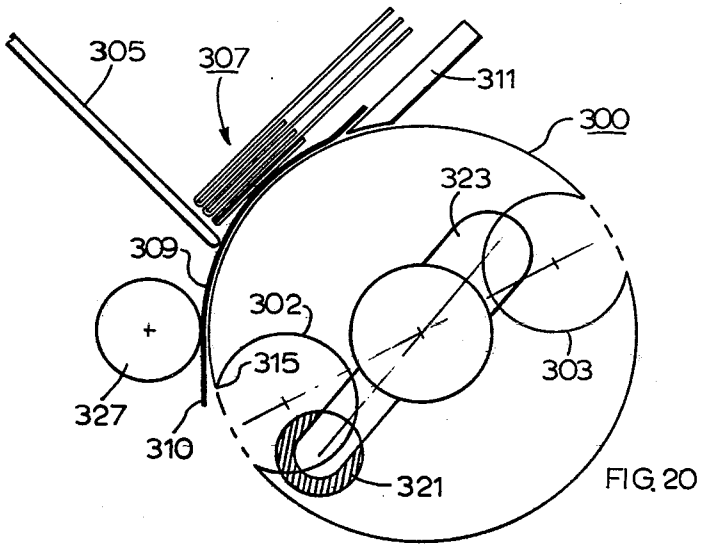

FIG. 18 shows the flap 310 fully unfolded and against high speed roller 327, but roller 327 cannot move product 309 until the operative edge 315 of cutout 302 presses the flap 309 against roller 327, to accelerate product 310 away from stack 307, as shown in FIG. 20. Since the angular velocity of arm 320 is twice that of drum 300, a second feeding cutout 303 is useful in each drum rotation.

Figure 21:
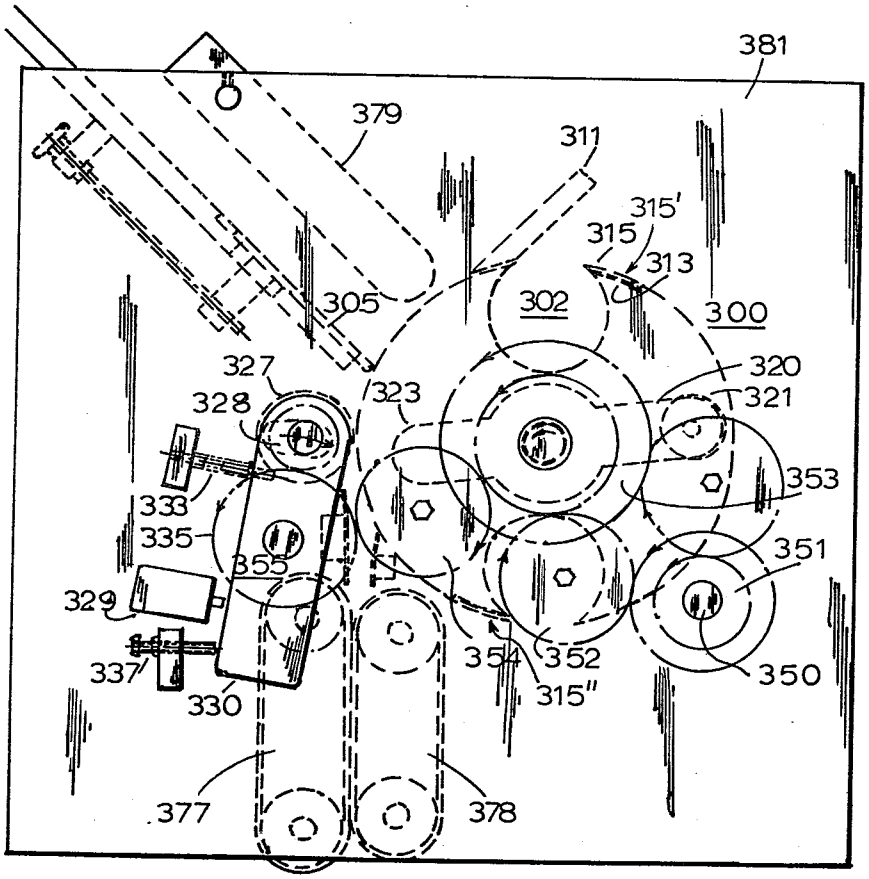
FIG. 21 is a view in side elevation of the unfolding type feeder.

Control of feeding, at the high speeds attained, is accomplished by moving roller 327 away from driving engagement at a predetermined time to avoid jams. In FIG. 21, roller 327 is shown carried by arm 330 which is pivotally mounted on shaft 332. Drive gear 335 drives roller 327 at the same surface speed as drum 300, and permits pivoting of arm 330 by solenoid 329 without interrupting the drive chain, but instantly stops product feeding. Compression spring 333 normally maintains the high speed roller 327 sufficiently close to drum 300 to provide feeding of any product introduced to the nip between drum 300, and roller 327 adjustable stop 337 insures non-contacting of roller 327 and drum 300 and enables some adjustment for product thickness.

The feeding should not be interrupted after a product has been gripped by the nip for feeding. Thus, a simple camming arrangement for the stop button (not shown) is used to render it ineffective when the structure is in the condition of either FIG. 19 or FIG. 20, but it is effective for the situations of FIGS. 13–18. Re-start is governed by the same conditions.

Figure 22:
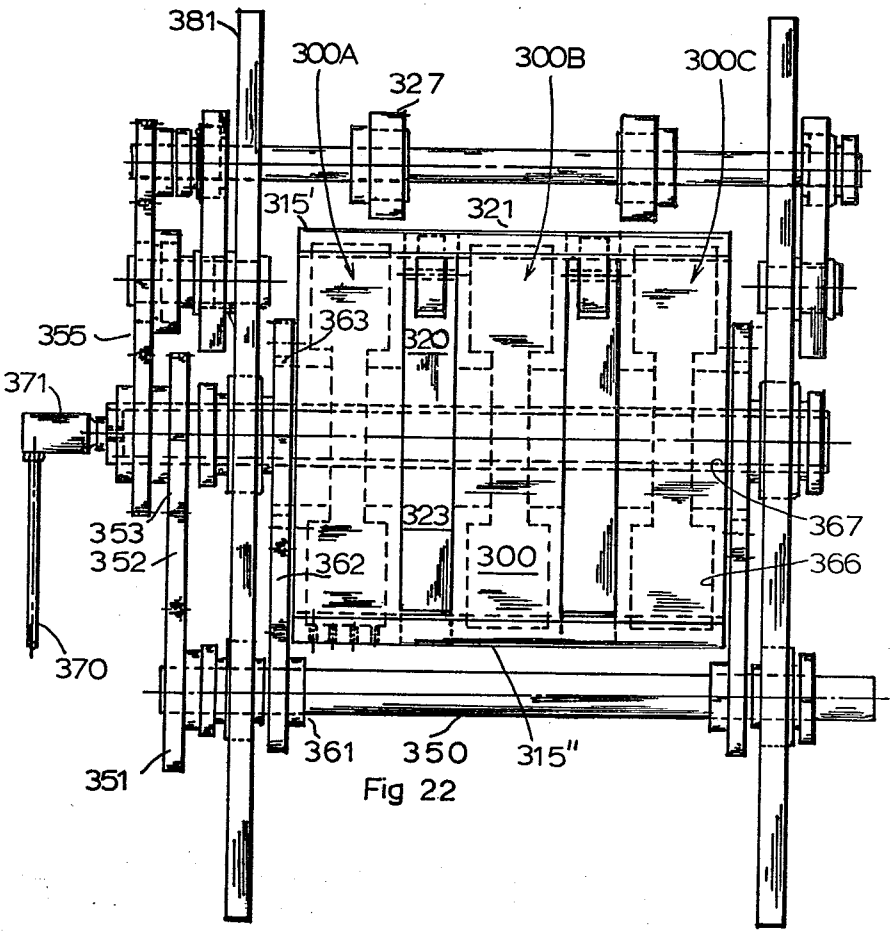
FIG. 22 is an end view of the feeder of FIG. 21.
Figure 22A:
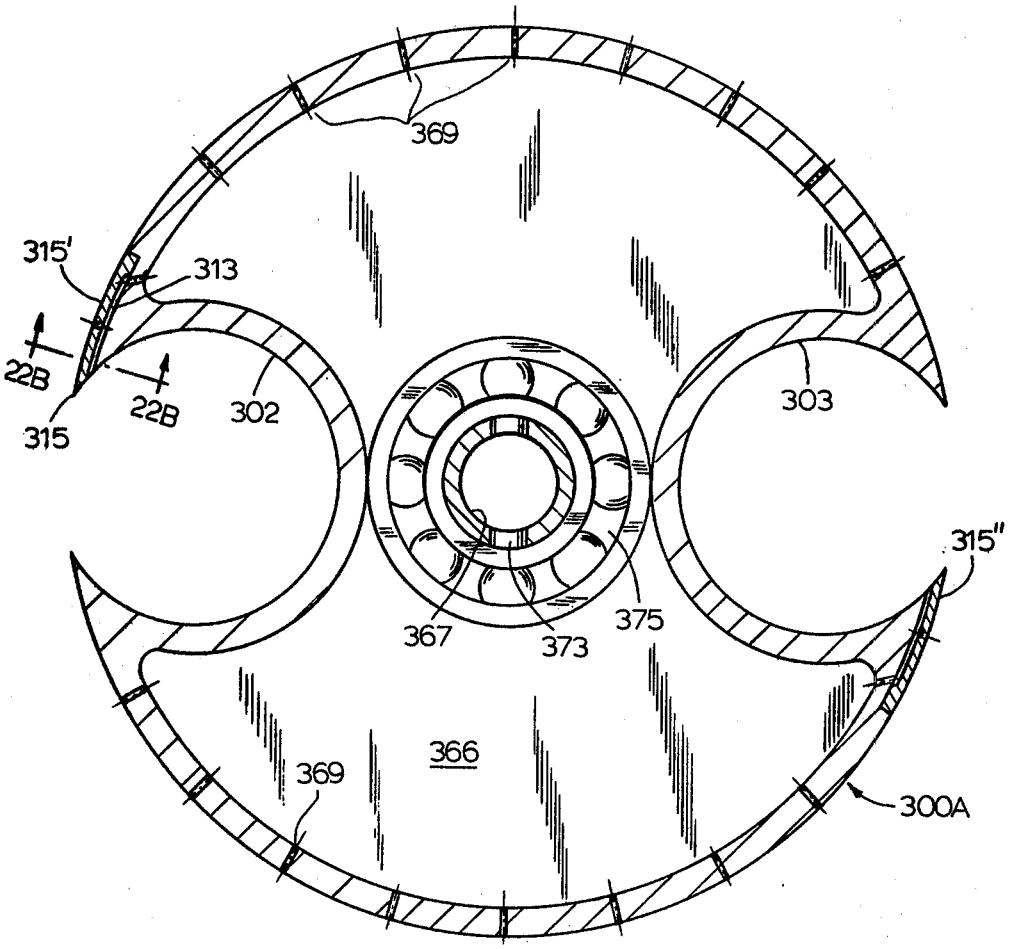
FIG. 22A is a cross sectional view through a drum section to reveal construction details.
Figure 22B:
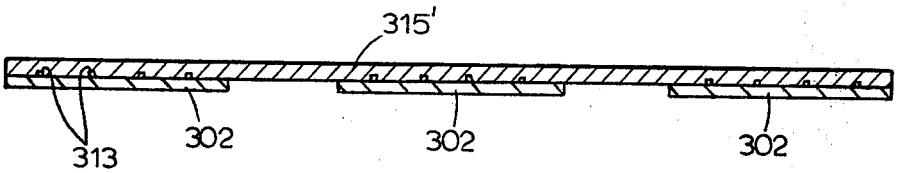
FIG. 22B is a view along plane 22B—22B of FIG. 22A to show the air jet arrangements.

The main drive shaft for the unfolding type feeder is shown at 350 in FIGS. 21 and 22. High speed rollers 321 are driven through gears 351, 352, 353, 354 and 355. The drum drive is via gears 361, 362 and 363. The drum 300 is made in three sections, 300A, 300B and 300C to facilitate the high volume air reaching its interiors 366 via hollow shaft 367. Sectional FIGS. 22A and 22B best show the interior construction. Air exits interior 366 via peripheral passageways 369 to reduce product to drum friction; and also exits forward of the operative edge 315 of cutouts 302 and 303 via passageway 313.

The drum sections, 300A–300C, are held together by knife edges 315′ and 315″. The air inlet passageway is conventional using tubular conduit 370 (FIG. 22) and rotary union 371 to communicate with hollow interior of shaft 367 (FIG. 22A) and out shaft openings 373 to drum hollow interior 366.

Each drum section includes two bearings 375, and each section is preferably cast. However, for limited production, the drum sections may be milled out and a cover plate (not shown) used to close each.

The output conveyors are shown at 377 and 378 to guide or "shoot" the products out at any desired direction. The products are aligned in the supply by adjustable side gates 379, and the main frame of the feeder are the side plates, such as 381.

INSERT RECEIVING CONVEYOR

Figures 23, 23A, 24:
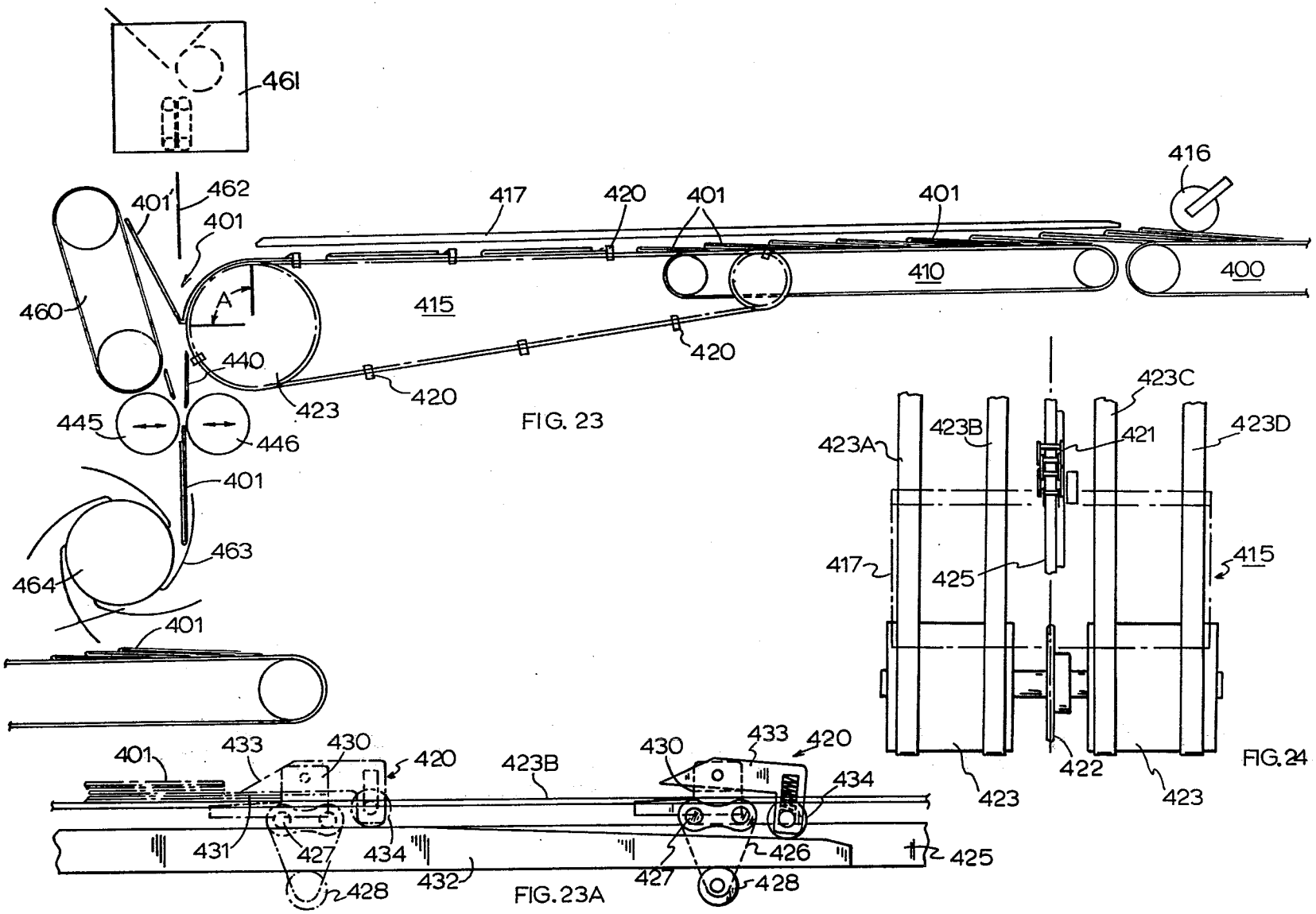
FIG. 23 is a view of side elevation of the new conveyor apparatus for handling finally assembled papers to receive inserts.
FIG. 23A is a detailed view of camming apparatus for use with the conveyor of FIG. 23.
FIG. 24 is a detailed view in plan of a portion of the apparatus of FIG. 23.

While the feeder mechanisms are independently useable, a very important in-line feeding method is illustrated by the apparatus of FIG. 23, wherein the press output or mail room conveyor is interrupted and the new apparatus inserted in the main stream flow path. No prior art feeders are known to exist which could feed the conveyor apparatus of FIG. 23 at press speeds nor is any prior art conveyor apparatus known which could receive separate inserts at press speeds.

Conveyor 400 is the existing press output or mail room conveyor bringing the shingled papers 401 from the press (not shown). This conveyor is continued at the lower left of FIG. 23, to take the inserted and re-shingled papers 401 to the mail room (not shown).

The present invention adds new conveyor 410 which is a speedup conveyor to partially increase the speed of the papers toward full un-shingled speed, at which opening conveyor 415 is running. Thus, conveyor 410 slips the papers relative to each other to reduce the normal two-thirds to three-quarters overlap to about ½ overlap. Idler wheel 416 rides on the top of the papers 401 just prior to the speed-up conveyor 410, to prevent subsequent papers from being pulled along. Upper guide plates (rails) 417 is used to retain the papers 401 on conveyors 410 and 415. This preventive measure also guards against air currents generated by air conditioning, heating, opening of doors, and the like.

Opening conveyor 415 includes spaced apart central pusher bars or clamps 420, carried by chain 421, which is driven by sprocket 422, carried by split drum 423 to accommodate the chain 421. The conveyor 415 may comprise the four belts 423A–423D, and the pushers 420 ride rail 425. Rail gripper 426 carries chain links 427 riding on the top of rail 425 and lower wheel 428 riding against the bottom of rail 425. An upright pusher 430 abuts the trailing edge of the paper 401 which is lip 431 (lowermost on conveyor 415) to push the paper. Pivotal arm 433 is spring yieldable as wheel 434 rides up ramp 432 to pivot arm 433 causing it to grip or clamp paper lip 432. The forward end of clamp 433 is knife shaped to permit it to extend randomly between pages of tabloids or booklets, not having a lip, when they are to be opened for inserts. The paper is slightly bowed between belts 423B and 423C, but the real purpose in clamping lip 431 is to retain the lowermost side of the paper against conveyor 415 as the paper comes onto large vacuum drum 423 which may have a diameter of one foot or more, for pusher spacing of approximately 14 inches which accommodates the average newspaper.

Split drum 423 distributes vacuum suction against the papers 401 for approximately 90 degrees as determined by fixed vacuum segment A. Drum 423 is perforated along its entire periphery so that vacuum always present in sector A holds the forward portion of the paper for directing it from the horizontal downwardly. Strippers 440 insure removal of the papers from the drum 423 and serve to guide the papers between adjustable rollers 445 and 446.

The upper portion 401 of papers 401 is flopped forward against conveyor 460 which has a surface speed equal to that of drum 423 and conveyor 415. This arrangement prevents jamming and enables paper 401 to remain open sufficiently long enough for feeder 461 to shoot product 462 into the paper.

The inserted paper travel downwardly into buckets 463 of bucket drum 464 which re-shingles them on exit conveyor 400, the same as they were shingled when coming off the press.

Feeder 461 may be of any of the types herein disclosed, and product 462 may also be of any type herein disclosed. Even booklets may be inserted at this point because the only remaining rollers (namely 445 and 446) are adjustable to accommodate different product thicknesses.

MULTIPLE PRODUCT INSERTER

Figure 25:
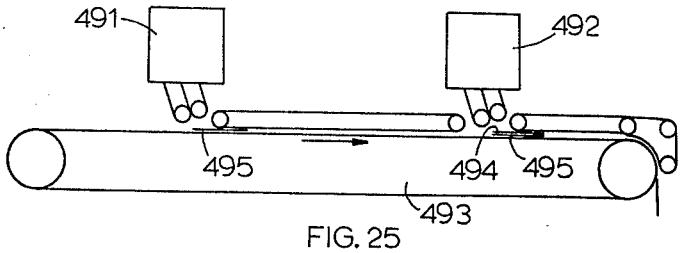
FIG. 25 is a schematic view of a multiple feeding apparatus.

FIG. 25 shows a method of combining inserts for multiple inserting into the papers 401 of conveyor 415. Two or more feeders 491, 492 discharge inserts onto conveyor 493 in timed relation so that insert 494 is stacked on top of insert 495. Output conveyors (not shown) may provide discharge of the stacked inserts at any desired angle for stuffing.

FIGS. 26 and 27 depict arrangements for bringing papers to the desired level for stuffing regardless of the press output conveyor level where an inserting operation is desired.

In FIG. 26, press output (or mail room) conveyor 500 is shown at ceiling level. To lower this level for convenience of supplying tons of inserts, downward conveyor 501 and horizontal conveyor 502 are added. Then, speed-up conveyor 503 and opening conveyor 504, as well as the rest of the apparatus of FIG. 26 are as previously described.

In FIG. 27, press conveyor 500′ is too low and the papers are directed to upward conveyor 501′, then horizontal conveyor 502′, and hence to the structure heretofore described.

What is claimed is:

1. Conveying apparatus for opening papers folded over to present at least two pages for stuffing of inserts between the pages, which papers are shingled on a conveyor and conveyed fold edge forward with pages trailing, comprising in combination:

means for un-shingling said papers by increasing the surface speed of travel thereof;

means for gripping each paper by clamping at the trailing edge only a part of the pages against the conveyor;

opener means for opening the pages of each paper not gripped by the gripping means away from those pages gripped by the gripping means;

said opener means comprising a vacuum distributing drum having means for communicating a vacuum to a portion of the surface of said drum for retaining over that sector the paper thereagainst, and rotating at a surface speed and having a diameter such that as the drum rotates the ungripped pages of said paper are opened by centrifugal force and some of the pages are able to flop over;

means for closing the pages opened by said opener means; and means re-shingling said papers having their pages closed.

2. The apparatus of claim 1 wherein:

said means for gripping comprise a high speed conveyor driven by said drum.

3. The apparatus of claim 2 wherein:

said means for un-shingling said papers by increasing the surface speed of travel thereof comprises a sequence of at least three cascaded conveyors of progressively increasing surface travel speeds.

4. The apparatus of claim 2 wherein said high speed conveyor encompasses a span long enough to receive and retain a plurality of individual gripper clamps for retaining single spaced un-shingled papers, and including cam actuation means for closing said clamps to grip said pages over a significant portion of said span.

5. The apparatus of claim 1 wherein:

said means for closing the pages comprises a further conveyor belt moving at the surface speed of said drum and disposed in spaced apart relation thereto to receive said open pages of the paper and convey them along with the drum conveyed pages of the paper; and a pair of speed-up rollers for receiving the opened paper fold foremost to accelerate it away from said drum.

* * * * *